US012692605B2

(12) United States Patent
Reichbauer et al.

(10) Patent No.: US 12,692,605 B2
(45) Date of Patent: Jul. 28, 2026

(54) CELL CONCEPT FOR USING NON-IONICALLY CONDUCTIVE EXTRACTION MEDIA

(71) Applicant: Siemens Energy Global GmbH & Co. KG, Munich (DE)

(72) Inventors: Thomas Reichbauer, Allershausen (DE); Günter Schmid, Hemhofen (DE); Yashar Musayev, Nuremberg (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 12 days.

(21) Appl. No.: 18/718,041

(22) PCT Filed: Oct. 24, 2022

(86) PCT No.: PCT/EP2022/079522

§ 371 (c)(1),
(2) Date: Jun. 9, 2024

(87) PCT Pub. No.: WO2023/110198

PCT Pub. Date: Jun. 22, 2023

(65) Prior Publication Data

US 2025/0043438 A1 Feb. 6, 2025

(30) Foreign Application Priority Data

Dec. 17, 2021 (DE) ..... 10 2021 214 631.7

(51) Int. Cl.

| | |
|---|---|
| ***C25B 9/00*** | (2021.01) |
| ***C25B 3/26*** | (2021.01) |
| ***C25B 9/15*** | (2021.01) |
| ***C25B 9/21*** | (2021.01) |
| ***C25B 11/032*** | (2021.01) |
| ***C25B 15/08*** | (2006.01) |

(Continued)

(52) U.S. Cl.
CPC ..... *C25B 3/26* (2021.01); *C25B 9/15* (2021.01); *C25B 9/21* (2021.01); *C25B 11/032* (2021.01); *C25B 15/083* (2021.01)

(58) Field of Classification Search
CPC ..... C25B 3/26; C25B 15/083; C25B 11/032; C25B 9/21; C25B 9/15
See application file for complete search history.

(56) References Cited

U.S. PATENT DOCUMENTS

2019/0252128 A1 8/2019 Ono
2021/0079538 A1* 3/2021 Schmid ..... C25B 9/19
(Continued)

FOREIGN PATENT DOCUMENTS

DE 102017223521 A1 6/2019
WO 2012118065 A1 9/2012
(Continued)

OTHER PUBLICATIONS

Yang Hongzouh et al: "Electrochemical conversion of C02 to formic acid utilizing Sustainion membranes"; Journal of C02 Utilization; vol. 20; 2017; S. 208-217 ISSN 2212-9820. 001:10.1016/j.jcou.2017.04.011.
(Continued)

*Primary Examiner* — Zulmariam Mendez
(74) *Attorney, Agent, or Firm* — Wolter Van Dyke Davis, PLLC

(57) ABSTRACT

A device for the electrolysis of $CO_2$ and/or CO, with which an effective extraction of a cathode product can be ensured. The device includes a first gas feed, a first ion exchange membrane, an anode space including an anode, an extraction space, an extraction medium incorporated in the extraction space, a first feed for the extraction medium, and a first drain for the extraction medium. A method for carrying out an electrolysis of $CO_2$ and/or CO, with which a corresponding extraction can be achieved with the device.

20 Claims, 7 Drawing Sheets

(56) References Cited

U.S. PATENT DOCUMENTS

| | | | |
|---|---|---|---|
| 2021/0180196 | A1 | 6/2021 | Schmid |
| 2022/0259746 | A1 | 8/2022 | Wang |

FOREIGN PATENT DOCUMENTS

| | | | |
|---|---|---|---|
| WO | 2015139129 | A1 | 9/2015 |
| WO | 2021011675 | A1 | 1/2021 |

OTHER PUBLICATIONS

Fan, Lei et al: "Electrochemical CO2 reduction to high-concentration pure formic acid solutions in an all-solid-state reactor"; Nature Communications; vol. 11; 2020; Item No. 3633 (S.1-9) ISSN 2041-1723. 001:10.1038/s41467-020-17403-1. URL: https://www.nature.com/articles/s41467-020-17403-1.

Xia, Chuan: "Continous production of pure liquid fuel solutions via electrocatalytic C02 reduction using solidelectrolyte devices"; Nature Energy; vol. 4.9; 2019; S. 776-785 ISSN 2058-7546. 001:10.1038/s41560-019-0451-x.

Martic et al; "Ag2Cu2O3—a catalyst template material for selective electroreduction of CO to C2+ products"; Energy & Environmental Science 13.9 (2020): 2993-3006 DOI: 10.1039/d0ee01100b; Accepted Jun. 29, 2020; 2020.

PCT International Search Report and Written Opinion of International Searching Authority mailed May 16, 2023 corresponding to PCT International Application No. PCT/EP2022/079522 filed Oct. 24, 2022.

German Search Report dated Jul. 29, 2022 of corresponding German Application No. 102021214631.7 filed Dec. 17, 2021; English machine translation attached.

* cited by examiner

CELL CONCEPT FOR USING NON-IONICALLY CONDUCTIVE EXTRACTION MEDIA

CROSS REFERENCE TO RELATED APPLICATIONS

This application is the US National Stage of International Application No. PCT/EP2022/079522 filed 24 Oct. 2022, and claims the benefit thereof, which is incorporated by reference herein in its entirety. The International Application claims the benefit of German Application No. DE 10 2021 214 631.7 filed 17 Dec. 2021.

FIELD OF INVENTION

The present invention relates to an apparatus for electrolysis of $CO_2$ and/or CO with which effective extraction of a cathode product can be assured, and to a method of performing an electrolysis of $CO_2$ and/or CO with which a corresponding extraction can be achieved.

BACKGROUND OF INVENTION

The combustion of fossil fuels currently covers about 80% of global energy demand. These combustion processes in 2011 resulted in the emission of around 34 032.7 million tonnes of carbon dioxide ($CO_2$) globally into the atmosphere. This release is the simplest way of disposing of even large volumes of $CO_2$ (for brown coal power plants more than 50 000 t per day).

Discussion about the adverse effects of the greenhouse gas $CO_2$ on the climate has led to consideration of reutilization of $CO_2$. In thermodynamic terms, $CO_2$ is at a very low level and can therefore be reduced again to usable products only with difficulty. However, there are approaches to reducing $CO_2$ electrochemically in electrolyzers and hence to producing and providing materials of value in chemistry and at the same time to reducing the volume of existing $CO_2$.

In nature, $CO_2$ is converted to carbohydrates by photosynthesis. This process, which is subdivided into many component steps over time and spatially at the molecular level, is very difficult to copy on an industrial scale. The more efficient route at present compared to pure photocatalysis is electrochemical reduction of $CO_2$. A mixed form is light-assisted electrolysis or electrically assisted photocatalysis. The two terms are used synonymously, depending on the point of view of the observer.

There is discussion at present of some possible routes for production of energy carriers and chemical commodities on the basis of renewable energies. A particularly desirable route is the direct electrochemical or photochemical conversion of $CO_2$ to hydrocarbons or oxygen derivatives thereof.

A major role is typically played here by copper as catalyst. Copper is currently the only known catalyst capable of reducing $CO_2$ to $C_{2+}$ products, for example ethene, n-propanol, ethanol, acetic acid, etc. Further possible catalysts are silver, gold (main product: CO) or tin, lead, bismuth (main product: formic acid).

Thus, if there are ways of producing CO, ethene, n-propanol, ethanol, acetic acid and/or formic acid, etc. from $CO_2$ with incorporation of renewable energy sources, this opens up a multitude of options for partly or completely replacing fossil resources as carbon source in many chemical products.

One possible route is the electrochemical breakdown of $CO_2$ to the abovementioned products and $O_2$. This is a one-stage process. It is customary here to use a gas diffusion electrode (GDE) at the cathode, one side of which is exposed to a flow of the reactant comprising or consisting of $CO_2$, and the other side of which contains a salt-containing electrolyte (often $KHCO_3$, $K_2CO_3$, $K_2SO_4$) as ion bridge to the anode side, which provides ionic conductivity and simultaneously ensures the extraction of liquid products. The catalyst layer of the GDE typically consists of a catalyst, e.g. copper, and a binder material (e.g. PVDF: polyvinylidene difluoride, PTFE: polytetrafluoroethylene) and/or an ion-conducting binder material (e.g. anion-conducting or cation-conducting binders).

However, there are some problems associated with this cell construction:

a. In order to ensure sufficient ionic conductivity, salts with metal cations are usually used (e.g. 1M $KHCO_3$ in water). Extracting the liquid products formed from the $CO_2$ electrolysis, such as various alcohols, acetic acid and formic acid, is usually inefficient and uneconomic. It would therefore be desirable to extract liquid main products from the $CO_2$ reduction (e.g. ethanol, about 28% FE in $CO_2$ electrolysis (Martic et al.; (2020), "$Ag_2Cu_2O_3$—a catalyst template material for selective electroreduction of CO to $C_{2+}$ products"; Energy Environ. Sci. 13 (2020) 2993)) directly into a suitable extraction medium, for example directly into an alcohol or more preferably into a water-immiscible or partly water-miscible extractant. However, ethanol is not of good suitability as extractant, as apparent from DIN 15938 "yT-209 Electrical conductivity in ethanol, bio-ethanol, and biofuel—Fast and easy conductivity measurement".

b. In addition, the effect of utilization of a salt-containing electrolyte is that continuous electrolysis operation is impossible. The production of formic acid and acetic acid, for example, in $CO_2$ electrolysis results in neutralization of the basic electrolyte:

$$KHCO_3+HCOOH \rightarrow HCOOK+H_2CO_3 \rightarrow HCOOK+H_2O+CO_2$$

Once the buffer capacity has been exhausted, dissolution of HCOOH (formic acid) and $CH_3COOH$ (acetic acid) in the electrolyte continues, which leads to acidification of the electrolyte. This acidification leads to a low pH of the cathode electrolyte. The low pH promotes the hydrogen evolution reaction (HER) at the cathode, which leads to inefficient $CO_2$ reduction.

FIG. 1 shows the cathode-side cell construction and the resulting problems for the reduction of $CO_2$ to CO, and also for the reduction of $CO_2$ to hydrocarbons. It is possible here for $CO_2$ on the cathode side, at the cathode K, in the form here by way of example of a Cu-containing gas diffusion electrode (GDE), to form at least one gaseous product G comprising, for example, CO, $C_2H_4$, $CH_4$, etc. Liquid products L such as ethanol, n-propanol, etc. can penetrate into an electrolyte space 3', into which an electrolyte El can be introduced, for example 1M $KHCO_3$ in water, which may be capable of dissolving these. It is additionally possible to feed in protons $H^+$ and/or the hydrated form thereof from the anode side (not shown in detail). In $CO_2$ electrolysis, it is additionally possible, as well as the liquid products L, for anions such as $HCO_3^-$, $CH_3CO_2^-$ and/or $HCO_2^-$ to form on the cathode side, which can likewise pass over into the electrolyte El in the electrolyte space 3. In the medium term, what is then formed is, for example, a mixture M1 comprising $KHCO_3$, HCOOK and $CH_3COOK$, and possibly other liquid products, but in the long term, in the case of acidification—after the buffer in the electrolyte El has been used up—a mixture M2 comprising HCOOK and $CH_3COOK$, HCOOH and $CH_3COOH$, and possibly other liquid products, which can make it difficult to separate off liquid products because of the higher complexity of the mixture. The formation of the acids and the dissolution thereof in the electrolyte El can then result in dominance of the HER, which distinctly lowers the efficiency of electrolysis.

In order to solve the problem, there are first approaches with cell constructions that make it possible to enrich or drain off acids in the electrolyte gap, but water is used for the purpose, which as before makes it difficult to separate off the products. These are described, for example, in Xia et al.; (2019), "Continuous production of pure liquid fuel solutions via electrocatalytic CO2 reduction using solid-electrolyte devices"; Nature Energy 4 (2019) 776-785; Fan et al.; (2020), "Electrochemical CO2 reduction to high-concentration pure formic acid solutions in an all-solid-state-reactor"; Nature Communications 11 (2020) 3633; and Yang et al.; (2017), "Electrochemical conversion of CO2 to formic acid utilizing Sustainion membranes"; Journal of CO2 Utilization 20 (2017) 208-217.

For effective removal of liquid products of $CO_2$ electrolysis, however, there is still a need for an improved method and an improved cell construction in the electrolysis of $CO_2$ and/or CO.

SUMMARY OF INVENTION

The inventors have found that it is possible with the aid of a combination of a specific cell arrangement combined with an extraction medium in an extraction space between the electrodes of an apparatus for electrolysis, for example an electrolysis cell, to achieve effective removal of liquid and/or soluble products of the electrolysis of $CO_2$ and/or CO.

In a first aspect, the present invention relates to an apparatus for electrolysis of $CO_2$ and/or CO, comprising a cathode space comprising a cathode gas space and a cathode, wherein the cathode is designed to convert $CO_2$ and/or CO from the cathode gas space to at least one first cathode product, wherein the cathode preferably takes the form of a gas diffusion electrode;

- at least one first gas feed which is connected to the cathode gas space and is designed to supply the cathode gas space with a first gas stream comprising $CO_2$ and/or CO;
- a first ion exchange membrane which contains an anion exchanger and adjoins the cathode space, wherein the cathode makes contact with the first ion exchange membrane;
- an anode space comprising an anode;
- an extraction space which is disposed between the first ion exchange membrane and the anode space, wherein the extraction space comprises a porous, ion-conducting solid-state electrolyte that makes at least partial contact with the first ion exchange membrane, wherein the first ion exchange membrane is configured to admit the at least one first cathode product at least partly into an adjacent extraction space and/or to convey it into the extraction space;
- wherein an extraction medium has been incorporated in the extraction space, wherein the extraction medium comprises water in an amount of 0% to 50% by weight, preferably 0% to 30% by weight, further preferably 0% to 10% by weight, and at least one organic solvent, wherein the extraction medium is designed to at least partly extract the at least one first cathode product and/or if appropriate at least one first product formed by reaction from the first cathode product;
- at least one first feed for the extraction medium, which is designed to supply the extraction space with the extraction medium; and
- at least one first drain for the extraction medium, which is designed to drain off the extraction medium comprising at least to some degree the at least one first cathode product and/or if appropriate the at least one first product.

A further aspect of the present invention relates to a method of electrolysis of $CO_2$ and/or CO in an electrolysis cell comprising

- a cathode space comprising a cathode gas space and a cathode, wherein the cathode preferably takes the form of a gas diffusion electrode,
- a first ion exchange membrane which contains an anion exchanger and adjoins the cathode space, where the cathode makes contact with the first ion exchange membrane,
- an anode space comprising an anode,
- an extraction space which is disposed between the first ion exchange membrane and the anode space, wherein the extraction space comprises a porous, ion-conducting solid-state electrolyte that makes at least partial contact with the first ion exchange membrane and wherein an extraction medium has been incorporated in the extraction space, wherein the extraction medium comprises water in an amount of 0% to 50% by weight, preferably 0% to 30% by weight, further preferably 0% to 10% by weight, and at least one organic solvent,
- the method comprising:
  - feeding the extraction medium through at least one first feed into the extraction space;
  - introducing a first gas stream comprising $CO_2$ and/or CO into the cathode gas space in such a way that the $CO_2$ and/or CO comes into contact with the cathode;
  - converting $CO_2$ and/or CO at the cathode to at least one first cathode product;
  - admitting or transferring the at least one first cathode product to the extraction space;
  - optionally converting the at least one first cathode product to at least one first product in the extraction space;
  - at least partly extracting the at least one first cathode product and/or if appropriate the at least one first product into the extraction medium; and
  - draining off the extraction medium comprising, at least to some degree, the at least one first cathode product and/or if appropriate the at least one first product from the extraction space via at least one first drain for the extraction medium.

Further aspects of the present invention can be inferred from the dependent claims and the detailed description.

The appended drawings are intended to illustrate embodiments of the present invention and to impart further understanding thereof. In association with the description, they serve to elucidate concepts and principles of the invention. Other embodiments and many of the advantages mentioned will be apparent with regard to the drawings. The elements of the drawings are not necessarily represented true to scale with respect to one another. Elements, features and components that are the same, have the same function and the same effect are, unless stated otherwise, each given the same reference numerals in the figures of the drawings.

Figure 3:
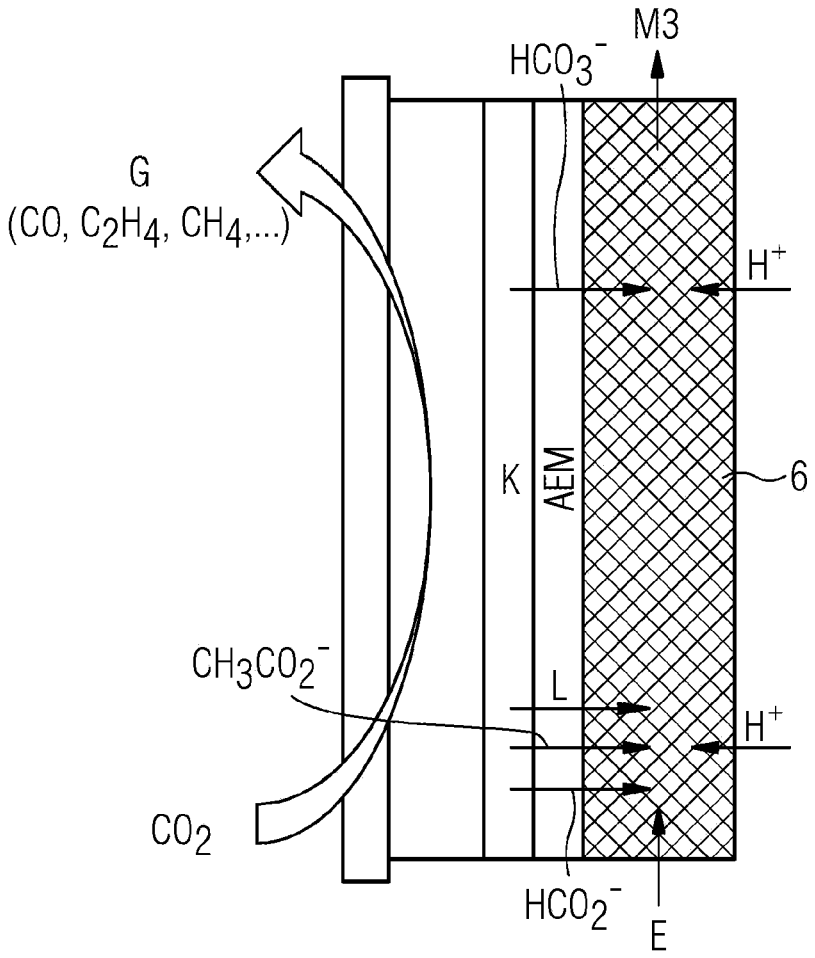

The processes in a cathode-side cell construction in an apparatus of the invention can be inferred from FIG. 3.

Figure 4:
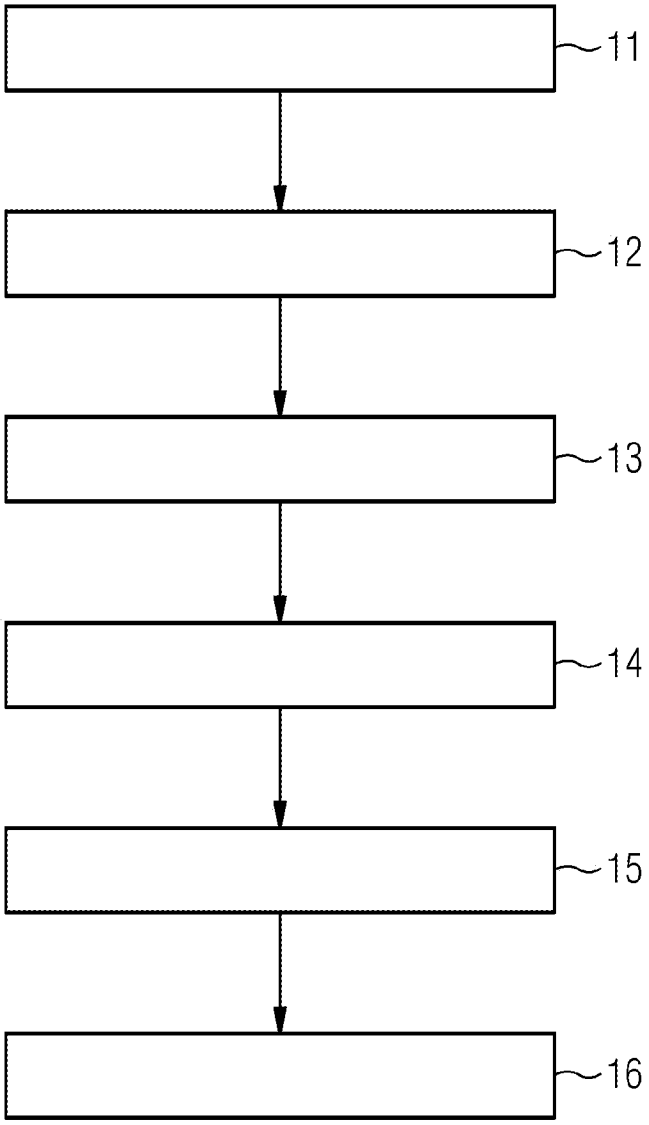
Figure 5:
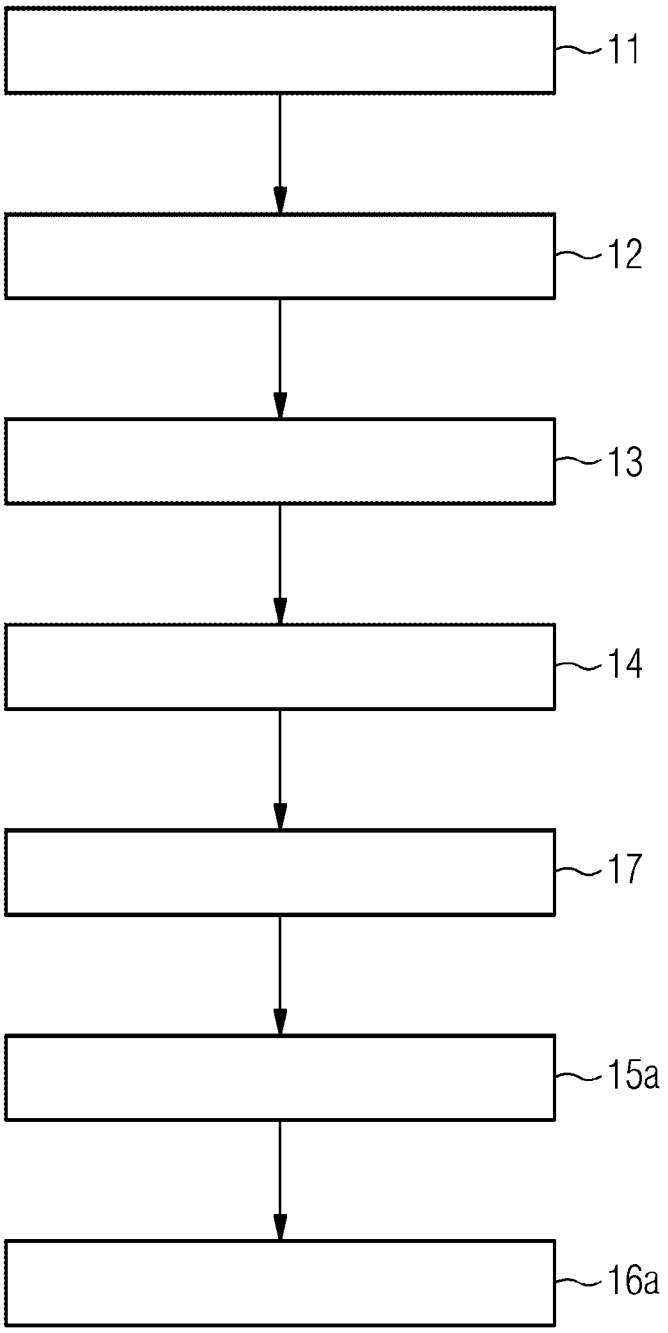

FIGS. 4 and 5 show illustrative methods of the invention in schematic form.

Figure 6:
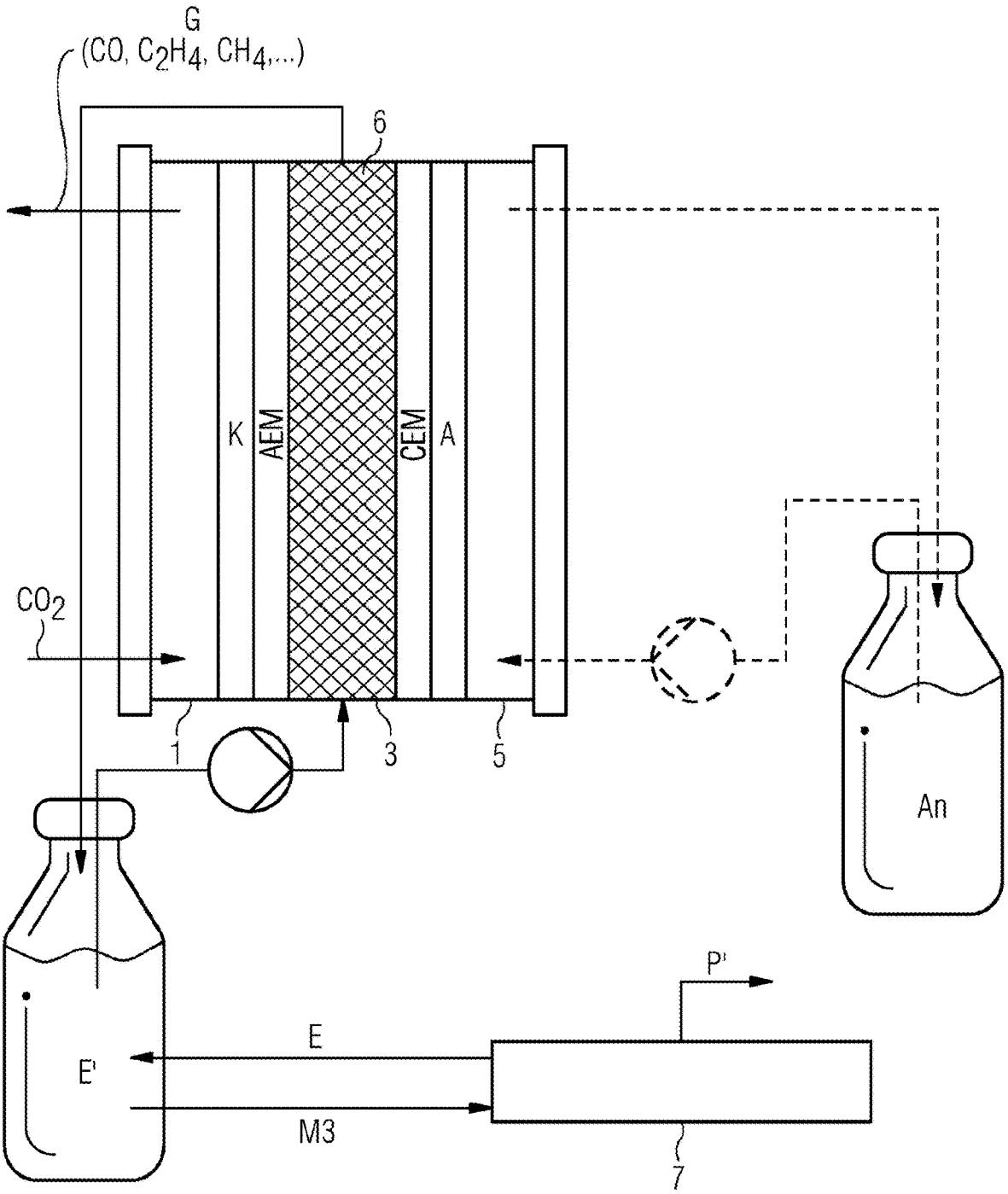

FIG. 6 shows the construction of an apparatus of the invention in example 1 in schematic form.

Figure 7:
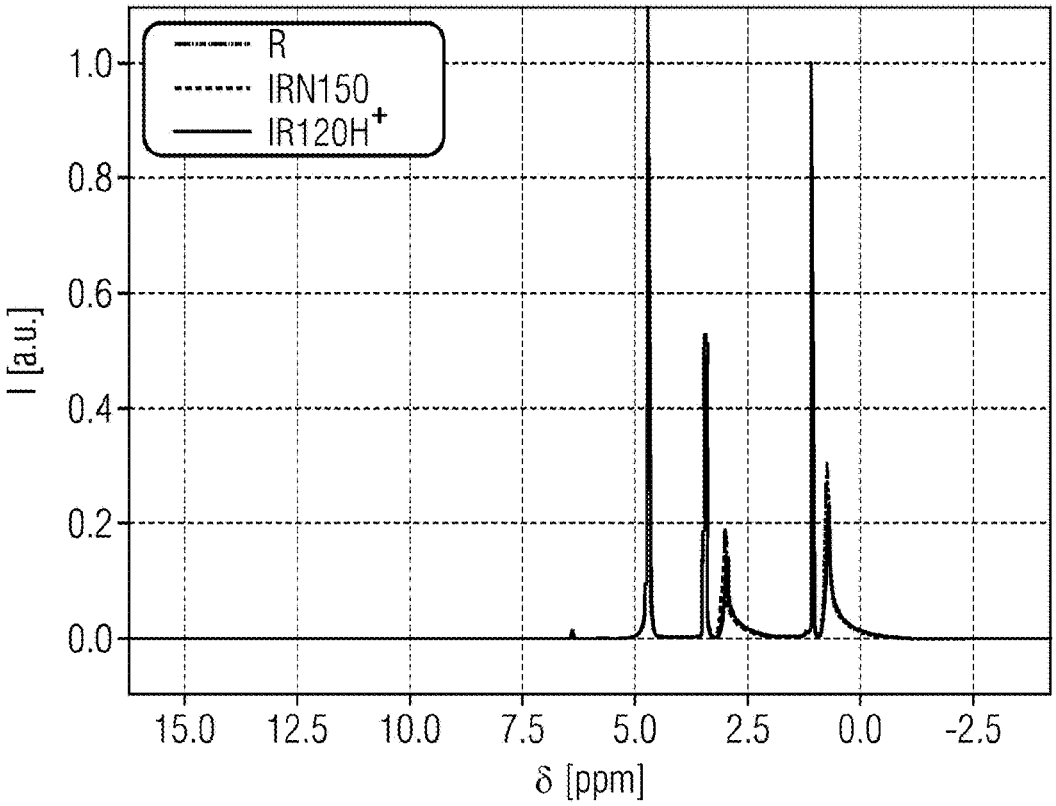
Figure 8:
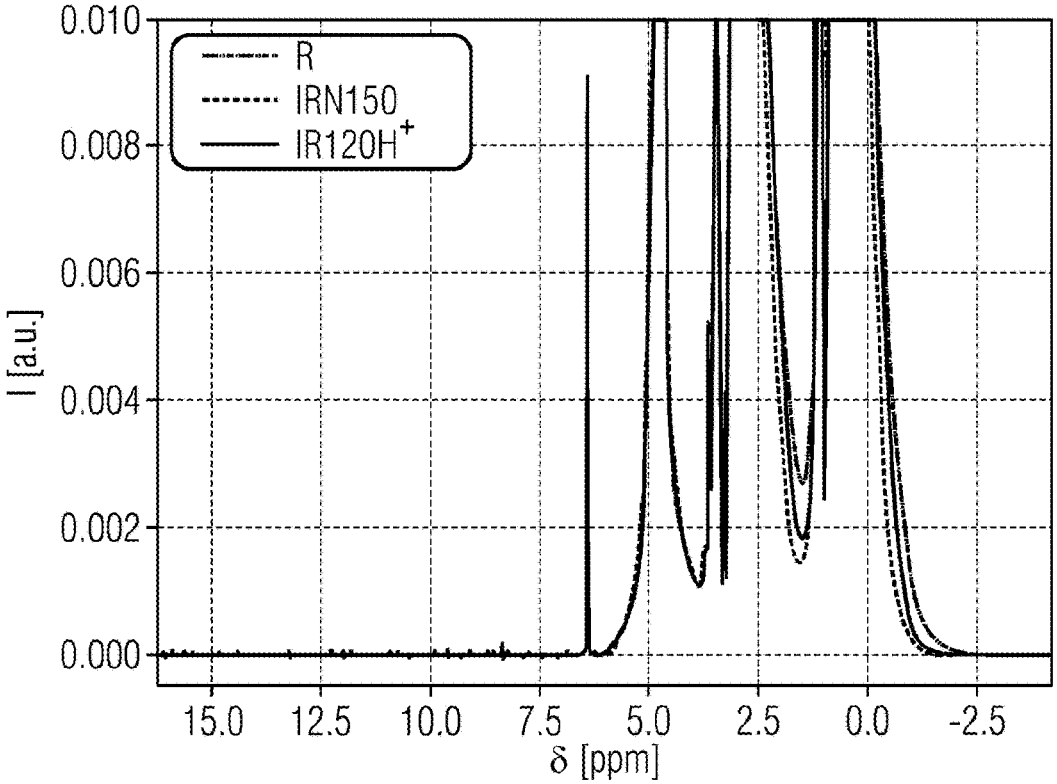

FIGS. 7 and 8 are NMR spectra that have been recorded in the course of inventive examples.

DETAILED DESCRIPTION OF INVENTION

Unless defined differently, technical and scientific expressions used herein have the same meaning as commonly understood by a person skilled in the art in the specialist field of the invention.

Gas diffusion electrodes (GDEs) are electrodes in which there are liquid, solid and gaseous phases, and where a conductive catalyst in particular catalyzes an electrochemical reaction between the liquid phase and the gaseous phase.

"Hydrophobic" in the context of the present invention means water-repellent. According to the invention, hydrophobic pores and/or channels are those that repel water. In particular, hydrophobic properties are associated in accordance with the invention with substances or molecules having nonpolar groups.

"Hydrophilic", by contrast, means the ability to interact with water and other polar substances.

In the application, figures are given in % by weight, unless stated otherwise or apparent from the context. In the gas diffusion electrode of the invention, the percentages by weight add up to 100% by weight.

Standard pressure is 101 325 Pa=1.01325 bar.

Electro-Osmosis:

"Electro-osmosis" means an electrodynamic phenomenon where a force toward the cathode acts on particles having a positive zeta potential that are present in solution, and a force toward the anode on all particles having negative zeta potential. If conversion takes place at the electrodes, i.e. there is flow of a galvanic current, there will also be a flow of matter of the particles having positive zeta potential to the cathode, regardless of whether the species is involved in the reaction or not. The same applies to a negative zeta potential and the anode. If the cathode is porous, the medium is effectively pumped through the electrode. This is also referred to as an electro-osmotic pump.

The streams of matter caused by electro-osmosis can also flow counter to concentration gradients. It is possible thereby to more than compensate for diffusion-related flows that balance out concentration gradients.

A separator is a barrier, for example a layer, which, in an electrolysis cell, can accomplish a spatial and, at least to some degree, also physical separation between different spaces in the electrolysis cell, and permits electrical separation between anode and cathode, but transport of ions between the different spaces. A separator in particular does not have a fixedly assigned potential like an electrode. A separator may, for example, be a two-dimensional barrier with uniform surface coverage. In particular, membranes and diaphragms should be regarded as specific examples of separators.

A first aspect of the present invention relates to an apparatus for electrolysis of $CO_2$ and/or CO, especially of $CO_2$, comprising a cathode space comprising a cathode gas space and a cathode, wherein the cathode is designed to convert $CO_2$ and/or CO, especially $CO_2$, from the cathode gas space to at least one first cathode product, wherein the cathode preferably takes the form of a gas diffusion electrode;

at least one first gas feed which is connected to the cathode gas space and is designed to supply the cathode gas space with a first gas stream comprising $CO_2$ and/or CO, especially $CO_2$;

a first ion exchange membrane which contains an anion exchanger and adjoins the cathode space, wherein the cathode makes contact with the first ion exchange membrane;

an anode space comprising an anode;

an extraction space which is disposed between the first ion exchange membrane and the anode space, wherein the extraction space comprises a porous, ion-conducting solid-state electrolyte that makes at least partial contact with the first ion exchange membrane, wherein the first ion exchange membrane is configured to admit the at least one first cathode product at least partly into an adjacent extraction space and/or to convey it into the extraction space;

wherein an extraction medium has been incorporated in the extraction space, wherein the extraction medium comprises water in an amount of 0% to 50% by weight, preferably 0% to 30% by weight, further preferably 0% to 10% by weight, and at least one organic solvent, wherein the extraction medium is designed to at least partly extract the at least one first cathode product and/or if appropriate at least one first product formed by reaction from the first cathode product;

at least one first feed for the extraction medium, which is designed to supply the extraction space with the extraction medium; and at least one first drain for the extraction medium, which is designed to drain off the extraction medium comprising at least to some degree the at least one first cathode product and/or if appropriate the at least one first product.

The apparatus for electrolysis is not particularly restricted here and may, for example, be an electrolysis cell, but also an apparatus comprising two or more electrolysis cells, for example including in one or more stacks, in which case each electrolysis cell has an anode and cathode. Accordingly, the apparatus may have corresponding feeds and/or drains, etc., which are not particularly restricted.

The apparatus of the invention, and also the method of the invention, serve, in particular preferred embodiments, for the electrolysis of $CO_2$, especially an electrolysis of $CO_2$ in which formic acid and/or $C_{2+}$ compounds such as ethanol, propanol, esters, etc. are formed, which have good extractability. For this purpose, the cathode may contain correspondingly suitable catalysts, e.g. Cu, Bi, etc.

In the apparatus of the invention, the cathode space comprising a cathode gas space and a cathode is not particularly restricted. The cathode is designed to convert $CO_2$ and/or CO from the cathode gas space to at least one first cathode product. The cathode in the method of the invention, and also in the apparatus of the invention, is not particularly restricted, but is at least partly porous in particular embodiments, i.e. has, for example, an at least partly porous or a porous structure. The expression "partly porous" here encompasses the possibility that the electrode as a whole is porous, as may be the case in gas diffusion electrodes for example, and also the possibility that only parts of the electrode are porous or even only partly porous, as in membrane-electrode assemblies for example. In particular embodiments, the electrode is a gas diffusion electrode, a catalyst layer, a membrane-bound electrode layer, or a membrane electrode assembly. The corresponding electrode types are of particularly good suitability for gas contacting with $CO_2$ and/or CO, and additionally create a good microstructure for good distribution of the catalyst, such that efficient contacting of the catalyst is enabled. The gas diffusion electrode, catalyst layer—for example on a suitable, nonlimited support—the membrane-bound electrode layer and the membrane-electrode assembly are not particularly restricted, and may include further constituents as well as the catalyst, for example for improvement of ion conductivity and/or electrical conductivity, for improved gas contacting, for protection of the electrode, etc., as already employed in corresponding electrodes, especially cathodes for electrolysis of $CO_2$ and/or CO.

In particular embodiments, the cathode is a gas diffusion electrode. A gas diffusion electrode may enable efficient gas transport and reduce or even prevent penetration of the electrolyte.

In particular embodiments, the cathode is a membrane electrode assembly (MEA), especially a ½ MEA (a ½ MEA here is an arrangement in which an electrode is applied only to one side of the membrane, by contrast to a standard MEA in a PEM, where the membrane exhibits an electrode applied on both sides). In case of such a ½ MEA, one side of the membrane, i.e. the first ion exchange membrane here, faces in the direction of the extraction medium, i.e. comes into contact with the extraction medium. A membrane electrode assembly in which, for example, a microporous catalyst layer may be applied to a nanoporous membrane, where the membrane preferably comes into contact with the electrolyte, may have the advantage over gas diffusion electrodes, for example, that it is possible to reduce or even prevent transfer of gas, for example of the first gas stream and/or of a product gas and/or of gas in the case of neutralization, into the electrolyte.

In general, it is also sufficient that only particular portions of the cathode are at least partly porous, for example even only the contact structure for contacting of the first gas stream comprising $CO_2$ and/or CO. The cathode may be formed from one or more layers, for example:

- porous layers of a binder polymer, inert filler particles and/or conductivity-mediating particles, for example for gas contacting;
- porous layers comprising a catalyst, i.e. reduction catalyst, for reduction of $CO_2$ and/or CO, for example consisting of binder polymer, optionally inert filler particles, optionally conductivity-mediating particles and a reduction catalyst;
- layers of ion-conducting/ion-selective polymers, conductivity-mediating particles and/or a catalyst;
- porous and/or continuous outer layers, for example of ion-conducting material, for example for protection of the cathode.

The conductivity-mediating particles, binder polymers, ion-conducting materials, inert filler particles, catalysts and optionally also further additives are not particularly restricted and may be those that are employed in electrodes for the reduction of $CO_2$ and/or CO.

In particular embodiments, the cathode comprises, as catalyst, a material selected from the list consisting of Ag, Al, Au, Bi, Cd, Ce, Co, Cr, Cu, Fe, Ga, Hf, Hg, In, Ir, Mn, Mo, Nb, Nd, Ni, Pb, Pd, Pt, Re, Rh, Ru, Sb, Si, Sm, Sn, Ta, Tb, Te, Tl, V, W, Zr, and oxides thereof and/or alloys and mixtures thereof, and further suitable catalysts. In particular embodiments, the catalyst comprises Cu.

In the method of the invention, the first gas stream comprising $CO_2$ and/or CO may be brought to the cathode in a suitable manner via a cathode gas space, which is not particularly restricted and is in contact with the cathode. A corresponding cathode gas space may be alongside the cathode, for example on one side, in which case the first ion exchange membrane may be on the other side of the cathode, or it may also be within the cathode, for example in a cathode configured as a gas diffusion electrode, in which case the first gas stream here can be introduced through the GDE, although this is not preferred. In particular preferred embodiments, there is a cathode gas space on one side of the cathode and the first ion exchange membrane on the other side of the cathode, where the two spaces are preferably separated by the gas diffusion electrode or by the cathode of correspondingly at least partly porous design.

In particular embodiments, the reactant for the electrolysis is $CO_2$ and/or CO—in other words, a first gas stream comprising $CO_2$ and/or CO, for example 20% by weight or more, 50% by weight or more, 70% by weight or more, 80% by weight or more, 90% by weight or more, 95% by weight or more, 99% by weight or more or even 100% by weight of $CO_2$ and/or CO, is directed into the cathode gas space. In particular embodiments, the reactant for the electrolysis is $CO_2$—in other words, a first gas stream comprising $CO_2$, for example 20% by weight or more, 50% by weight or more, 70% by weight or more, 80% by weight or more, 90% by weight or more, 95% by weight or more, 99% by weight or more or even 100% by weight of $CO_2$ based on the gas comprising $CO_2$, is directed into the cathode gas space.

In the apparatus of the invention, moreover, the at least one first gas feed is not particularly restricted, provided that it is capable of supplying the cathode gas space with the first gas stream comprising $CO_2$ and/or CO as reactant. The first gas stream comprising $CO_2$ and/or CO may be gaseous here, but may also include, for example, liquid droplets, for example water droplets to moisten the gas. The at least one first gas feed may supply the first gas stream in a suitable manner to the cathode gas space, for example directly to the cathode, and/or along the cathode, in countercurrent or in flow direction with respect to the flow direction of the extraction medium in the extraction space, for example in countercurrent, in order to achieve improved enrichment of the at least one first cathode product and/or optionally the first product.

Moreover, at least one first gas drain may also be provided, which is connected to the cathode gas space and is designed to drain off, if appropriate, at least one first gaseous product of the reaction at the cathode and/or unconverted reactant and/or further constituents of the first gas stream.

In addition, the first ion exchange membrane is not restricted either, provided that it contains an anion exchanger and adjoins the cathode space, where the cathode makes contact with the first ion exchange membrane. The first ion exchange membrane is between the cathode, for example in the form of a gas diffusion electrode, and the extraction space or the solid-state electrolyte present therein.

In particular, the first ion exchange membrane may be an anion exchange membrane or an anion-conducting membrane (AEM). The first ion exchange membrane functions as acid blocker and makes it possible to concentrate any acids formed in the extraction medium without a drop in the pH or the $H^+$ activity of the liquid extraction medium to such an extent that only hydrogen is produced. In particular, the first ion exchange membrane is essentially not soluble in the extraction medium, i.e. has a solubility, for example, of less than 0.1 mol of the ion exchange membrane material per liter of extraction medium, further preferably of less than 0.01 mol/L, even further preferably less than 0.001 mol/L, and is in particular insoluble in the extraction medium. For this purpose, the first ion exchange membrane may also be suitably adjusted to the extraction medium. The first ion exchange membrane is especially polymer-based, i.e. especially comprises a polymer, and is especially crosslinked. The first ion exchange membrane is especially based on polymer resin, for example aromatic polymer resin and/or (meth)acrylic-based polymer resin. The anion-exchanging groups or the anion exchanger in the first ion exchange membrane is not particularly restricted. In particular embodiments, the first ion exchange membrane is an anion exchange membrane, preferably based on polymer resin, preferably aromatic polymer resin. Examples of a suitable first ion exchange membrane are Sustainion® membranes from Dioxide Materials, Aemion+™ membranes from Jonomer Innovations, and PiperION membranes from Versogen.

In particular embodiments, the first ion exchange membrane has a conductivity of 20 mS/cm or more, preferably 50 mS/cm or more, further preferably 100 mS/cm or more, and/or 300 mS/cm or less, preferably 200 mS/cm or less.

Use of the first ion exchange membrane can ensure continuous operation, without neutralization of the electrolyte, which would result in dominant hydrogen formation at the cathode. In the borderline case, organic acids formed, such as formic acid and/or acetic acid, may be enriched in high concentration, e.g. 50-100% by weight.

Furthermore, the anode space comprising an anode is not particularly restricted. The anode space may surround the anode or adjoin one side of the anode. There may be an anolyte in the anode space, and/or a reactant for the anode reaction may be supplied to the anode space. If water is converted at the anode, this may optionally also be supplied by the extraction medium, or else may not.

In particular embodiments, the anode comprises an oxidation catalyst applied directly, for example, to a separator, for example a membrane. The anode here may take the form, for example, of a coated membrane (CCM, catalyst coated membrane), of an electrode composite (MEA, membrane electrode assembly), or of a catalyst-coated contact structure (e.g. nonwoven-like structures composed, for example, of carbon or titanium), pressed directly onto the membrane. A GDE is another conceivable anode.

The anode reaction is not particularly restricted. One example of a suitable anode reaction here is a water oxidation. Examples of useful media for the anode space include acid, e.g. $H_2SO_4$, or else water and/or gas.

It is also the case that an oxidation catalyst on and/or in the anode is not particularly restricted. The oxidation catalyst of the anode may be chosen, for example, from the list of elements Ir, Pt, Ni, Ru, Pd, Au, Co, Fe, Mn, W, compounds and alloys thereof, especially IrRu, PtIr, Ni, NiF, and compounds thereof with further elements, especially Ba, Cs, P, K, Na, O, and steel and other suitable oxidation catalysts. The selection of the catalyst is determined in particular by the pH at the anode.

There are no restrictions in respect of an anode space. For example, the anode space may not have any liquid electrolyte, i.e. may be configured as an anode gas space, or the anode space may comprise an anolyte, in which case there is optionally an adjoining anode gas space on another side of the anode, or the anode space may comprise a liquid reactant, etc. If an anode gas space is present, it may have at least one second feed for an anode reactant stream comprising anode reactant, e.g. water, and optionally further constituents (for example for an improved anode reaction) and optionally at least one second drain for anode product and/or unconverted anode reactant and/or further constituents of the anode reactant stream, if required. The anode gas space may be supplied, for example, with an anode reactant gas, and/or with a purge gas. If an anolyte is present, there may correspondingly also be at least one corresponding electrolyte feed and at least one corresponding electrolyte drain. An anolyte in this case may be circulated. For this purpose, an anolyte may be pumped in circulation, for example via a suitable pump or the like.

Appropriate reservoirs may be provided for any anolyte present, the extraction medium, optionally also purge gas, etc., in order to prevent fluctuations in supply.

The extraction space disposed between the first ion exchange membrane and the anode space comprises a porous, ion-conducting solid-state electrolyte that makes at least partial contact with the first ion exchange membrane. The solid-state electrolyte serves here for electronic connection between cathode space and anode space, i.e. assumes the role that is typically assumed by liquid electrolytes in electrolyte gaps. Furthermore, the extraction space is not particularly restricted.

The porous, ion-conducting solid-state electrolyte is not particularly restricted, apart from the arrangement thereof in the extraction space with at least partial contacting of the first ion exchange membrane and the anode and/or optionally a separator on the anode side, which is described hereinafter. In particular, the porosity of the solid-state electrolyte is not particularly restricted, provided that an extraction medium can be passed through, or can flow through, the solid-state electrolyte.

In particular embodiments, the solid-state electrolyte has been hydrated. By virtue of the solid-state electrolyte, it is possible to achieve separation of the draining of electrolysis products in the extraction space from the ionic conductivity between cathode and anode.

In particular embodiments, the solid-state electrolyte is essentially not soluble in the extraction medium, for example an alcohol, ether, etc., i.e. has a solubility, for example, of less than 0.1 mol of the solid-state electrolyte material per liter of extraction medium, further preferably of less than 0.01 mol/L, even further preferably less than 0.001 mol/L, and is especially insoluble in the extraction medium. For this purpose, the solid-state electrolyte may also be suitably adjusted to the extraction medium. The solid-state electrolyte is especially polymer-based, i.e. especially comprises a polymer, and may also be crosslinked. The solid-state electrolyte is especially based on polymer resin, for example aromatic polymer resin and/or (meth)acrylic-based resin, for example acrylic resin and/or styrene resin, especially crosslinked styrene resin.

The porous solid-state electrolyte may be anion-conducting, cation-conducting or else both. In particular embodiments, the porous, ion-conducting solid-state electrolyte has a conductivity of 20 mS/cm or more, preferably 50 mS/cm or more, further preferably 100 mS/cm or more, and/or 300 mS/cm or less, preferably 200 mS/cm or less, in order to keep ohmic losses as small as possible.

In particular embodiments, the porous, ion-conducting solid-state electrolyte is a cation exchange resin, an anion exchange resin, and/or a resin having cation-exchanging and anion-exchanging groups. The cation-exchanging and anion-exchanging groups in the solid-state electrolyte are not particularly restricted.

Examples of a suitable solid-state electrolyte are various Amberlites® such as IRN150 (anion- and cation-conducting), IRA 120 $H^+$ (cation-conducting) and Dowex® 50WX2 (cation-conducting). The construction with solid-state electrolyte in the extraction space enables the utilization of an extraction medium that need not be ion-conducting.

Use of the ion-conducting porous solid-state electrolyte makes it possible to decouple ion conductivity and extraction. This makes it possible to use not only aqueous electrolytes (e.g. $KHCO_3$) or water for extraction, but also water-miscible liquids (e.g. alcohols such as ethanol) or else water-immiscible media such as polyethers. The selection of an extraction medium or of a mixture of different extraction media may be defined here by the boiling points of the products, in order to assure effective extraction and removal of the products after accumulation.

In the apparatus of the invention, the first ion exchange membrane is configured such that the at least one first cathode product may be admitted at least partly into the adjoining extraction space and/or conveyed into the extraction space. For example, liquid cathode products, i.e. at least the first cathode product, may be conducted through the ion exchange membrane. In addition, however, it is alternatively possible to convey anions formed at the cathode, such as $HCO_3^-$, $CH_3CO_2$ and/or $HCO_2^-$, through the first ion exchange membrane. These anions can then react with protons that may form in the anode reaction and form one or more first products. The at least one first cathode product and/or optionally the at least one first product may then be extracted in the extraction space, i.e. dissolved in the extraction medium and/or taken up in some other way.

An extraction medium has been incorporated in the extraction space, where the extraction medium comprises water in an amount of 0% to 50% by weight, preferably 0% to 30% by weight, further preferably 0% to 10% by weight, based on the extraction medium, and at least one organic solvent, where the extraction medium is designed to at least partly extract the at least one first cathode product and/or if appropriate at least one first product formed by reaction from the first cathode product. In particular embodiments, the extraction medium should have a water content between 0% and 50% by weight inclusive; the water content should preferably be between 0-30% by weight inclusive, more preferably between 0% and 10% by weight inclusive. In particular embodiments, the extraction medium comprises essentially no water, i.e., for example, less than 5% by weight, less than 4% by weight, less than 3% by weight, less than 2% by weight, or less than 1% by weight, based on the extraction medium, or even comprises no water, possibly apart from water impurities in the at least one organic solvent. In particular embodiments, the extraction medium may comprise water, for example also as reactant for the anode. In particular embodiments, the extraction medium consists of water in an amount of 0% to 50% by weight, preferably 0% to 30% by weight, further preferably 0% to 10% by weight, based on the extraction medium, and at least one organic solvent, i.e. no further constituents are included, apart from unavoidable impurities. In particular embodiments, the extraction medium does not comprise any conductive salt, or even any salt, by contrast with conventional electrolytes. In particular embodiments, the extraction medium does not comprise any organic cations and/or any metal cations. There is no need for a conductive salt because of the presence of the solid-state electrolyte. In particular embodiments, the extraction medium has a conductivity of 50 mS/cm or less, preferably 20 mS/cm or less, further preferably 10 mS/cm or less, even further preferably 5 mS/cm or less.

The at least one organic solvent is not particularly restricted. The at least one organic solvent may be matched here to a product to be extracted and may also take the form of a mixture of two or more organic solvents. For example, the organic solvent is selected from alcohols having 1 to 20 carbon atoms, esters, e.g. carboxylic esters, having 2 to 20 carbon atoms, ethers having 2 to 20 carbon atoms, polyethers having 3 to 20 carbon atoms, and/or aliphatic solvents having 5 to 20 carbon atoms, preferably from alcohols having 1 to 20 carbon atoms, esters, e.g. carboxylic esters, having 2 to 20 carbon atoms, ethers having 2 to 20 carbon atoms, and/or polyethers having 3 to 20 carbon atoms. In particular embodiments, the organic solvent is selected from alcohols having 1 to 15 carbon atoms, esters having 2 to 15 carbon atoms, and/or ethers and/or polyethers having 2 to 15 carbon atoms.

The organic solvents may be classified into those that are water-miscible, e.g. alcohols $CH_3—(CH_2)_n—OH$, n=0-15, or esters, e.g. carboxylic esters, and those that are barely water-miscible or preferably water-immiscible, for example ethers, e.g. diethyl ether (solubility: 29 g/L of water) or di-n-propyl ether (solubility: 3.8 g/L of water), but preference is given to polyethers, for example of the following formula $CH_3—(O—CH_2—CH_2)_n—CH_2—OH$, n=1-15.

For ethanol as product of the electrolysis, for example, preferred constituents of the extraction medium or a preferred extraction medium would be polyethers having a boiling point higher than that of ethanol (boiling point=78 degrees), i.e. >80 degrees. However, particular preference would be given to polyethers having a boiling point>120 degrees. For n-propanol (boiling point=97 degrees) as product of the electrolysis, for example, preferred constituents of the extraction medium or a preferred extraction medium would be polyethers having a boiling point>100 degrees; the boiling point should more preferably be >140 degrees. Specifically for acetic acid (boiling point=118 degrees) as product of the electrolysis, advantageous constituents of the extraction medium or an advantageous extraction medium would be polyethers having a boiling point>120 degrees, but more preferably having a boiling point>160 degrees. Accordingly, the organic solvent in the extraction medium may be matched to a product to be extracted.

The at least one first feed for the extraction medium which is designed to supply the extraction space with the extraction medium and the at least one first drain for the extraction medium which is designed to drain off the extraction medium comprising, at least to some degree, the at least one first cathode product and/or if appropriate the at least one first product are not particularly restricted, and may be designed in the form of suitable conduits, pipes, etc., where these are matched to the extraction medium, for example with regard to the material thereof.

In particular embodiments, the apparatus of the invention further comprises a first separator disposed between the anode space and the extraction space, where the porous, ion-conducting solid-state electrolyte makes at least partial contact with the first separator. The separator here can separate the extraction space from the anode or anode half-cell. In general, ion-conducting membranes and/or porous diaphragms are suitable here. In particular embodiments, the separator is a cation exchange membrane. In the case of cation conductivity of the separator, cations are transported from the anode into the extraction space, and these can react with anions from the $CO_2$ reaction, for example to give formic acid and/or acetic acid. Since cations are generally formed at the anode (often $H^+$, for example in the case of evolution of oxygen in the acidic/neutral medium), a stable system can be formed thereby. In particular embodiments, $H^+$ is produced at the anode, for example in an oxidation of water. It is preferable here that a separator is then a cation-conducting membrane. The anion conductivity of the first ion exchange membrane additionally allows anions to move from the catholyte space in the direction of the anode. By-products formed at the cathode from the $CO_2$ reduction reaction are, for example, hydrogen-carbonates and/or carbonates ($HCO_3^-$ and/or $CO_3^{2-}$), which can be balanced out by protons from the anode reaction. Therefore, cation-selective membranes are particularly preferred as separator. Examples here are, for example, polymers and copolymers based on perfluorosulfonic acid, commercially available, for example, as Nafion® from DuPont and Fumion® from Fumatec.

Figure 2:
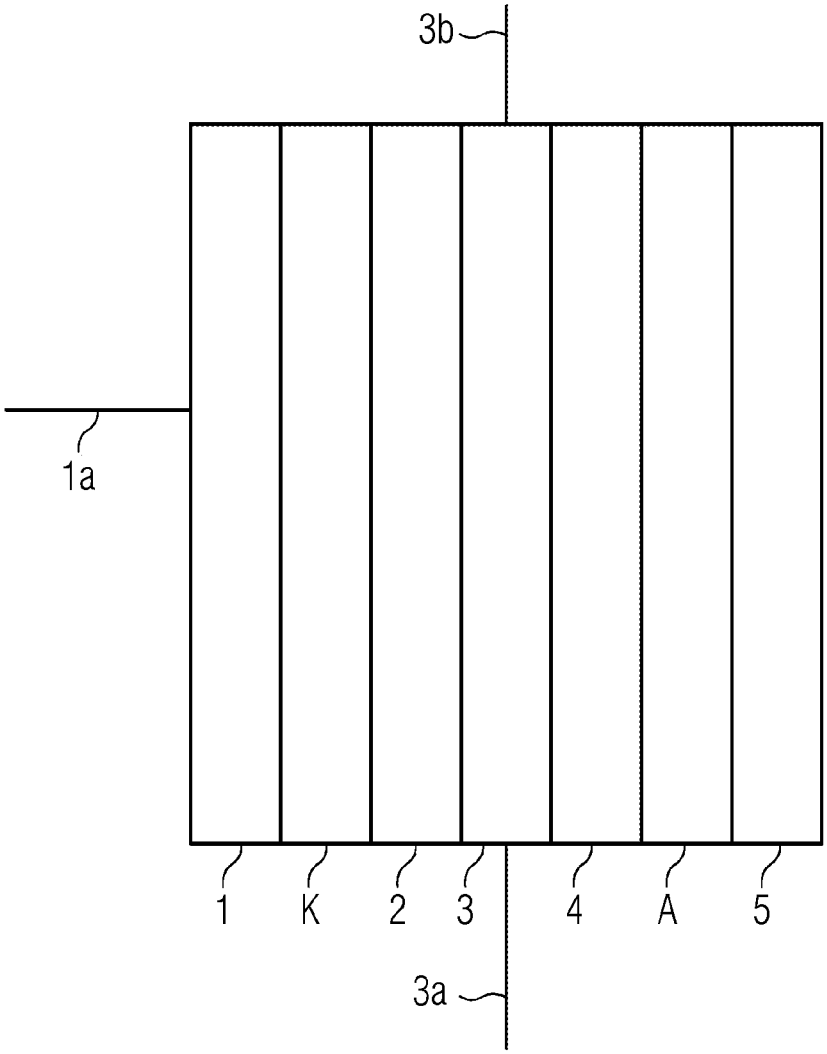
FIG. 2 shows an illustrative apparatus of the invention in schematic form.

FIG. 2 shows an illustrative apparatus of the invention in schematic form. A first gas feed 1*a* can be used to supply the cathode gas space 1 with a first gas stream comprising $CO_2$ and/or CO. $CO_2$ and/or CO can then be converted at the cathode K, which adjoins and makes contact with the first ion exchange membrane 2 here. The cathode gas space 1 and the cathode K here form the cathode space. It is possible for at least one first cathode product to be admitted and/or even conveyed through the ion exchange membrane 2 into the extraction space 3. The extraction space 3, which contains an extraction medium, is supplied with the extraction medium via the first feed for the extraction medium 3*a*, and this is drained off therefrom via the first drain for the extraction medium 3*b*. The extraction space 3 here comprises a porous, ion conducting solid-state electrolyte (not shown). The extraction space 3 is joined here by a separator 4, for example a cation exchange membrane, followed by the anode A and an illustrative anode gas space 5 that forms the anode space here together with the anode A.

Figure 1:
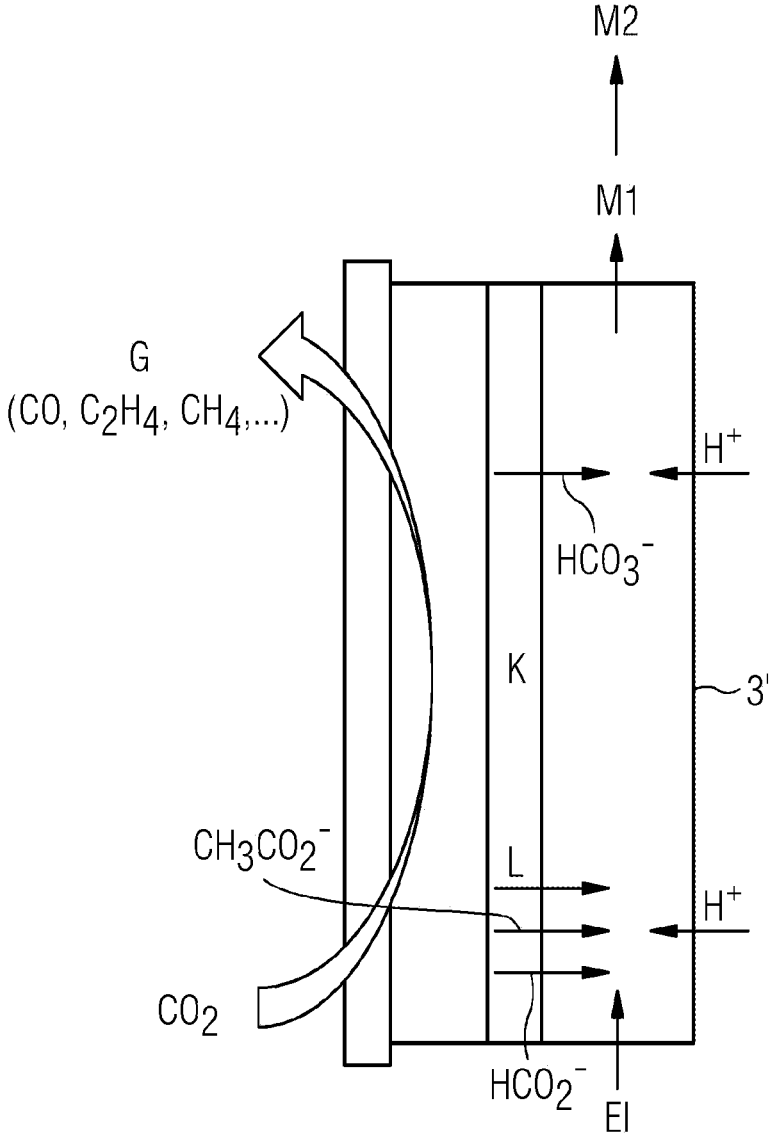
FIG. 1 shows a cathode-side cell construction of an electrolysis cell for $CO_2$ electrolysis according to the prior art.

FIG. 3 shows, for this illustrative apparatus, an illustrative cell construction on the cathode side with an illustrative anion exchange membrane AEM or anion-conducting membrane AEM as the first membrane installed between a copper GDE as illustrative cathode K and the extraction space with the solid-state electrolyte 6. The cathode reaction in FIG. 3 corresponds to that in FIG. 1. By way of example, liquid products and anions are guided to the extraction space or extraction gap via the AEM. In the extraction space, ionic conductivity is ensured by the porous solid-state electrolyte 6, while the extraction of the products is ensured by means of a suitable extraction medium E. After passage through the extraction space, a mixture M3 with extraction medium comprising, at least to some degree, the at least one first cathode product and/or if appropriate the at least one first product is obtained.

In particular embodiments, the at least one first cathode product and/or if appropriate the at least one first product are concentrated in the extraction medium before being separated off. The concentration is not particularly restricted and may comprise, for example, repeated recycling of the extraction medium, but also introduction into apparatuses for concentration, for example by selective removal of extraction medium, in order to make the separation as efficient as possible. The degree of accumulation here is preferably between 0-100%, further preferably between 20-60%, but more preferably between 60-100%. By suitable choice of the extraction medium and of the degree of accumulation of the at least one first cathode product and/or if appropriate the at least one first product, it is possible to guarantee effective separation from the extraction medium without detriment to ionic conductivity.

In particular embodiments, the at least one first feed for the extraction medium and the at least one first drain for the extraction medium are connected such that the extraction medium can be circulated. The connection here is not particularly restricted and may also comprise, for example, at least one pump in order to circulate the extraction medium.

In particular embodiments, the apparatus of the invention comprises a withdrawal apparatus for the at least one first cathode product and/or if appropriate the at least one first product. The withdrawal apparatus is not particularly restricted and may comprise, for example, an apparatus in which the at least one first cathode product and/or optionally the at least one first product is separated from the extraction medium because of a difference in the evaporation temperature, i.e., for example, by an evaporation apparatus, optionally under reduced pressure. However, other separation apparatuses are likewise also possible, for example columns, etc.

A further aspect of the present invention relates to a method of electrolysis of $CO_2$ and/or CO, especially $CO_2$, in an electrolysis cell comprising

- a cathode space comprising a cathode gas space and a cathode, wherein the cathode preferably takes the form of a gas diffusion electrode,
- a first ion exchange membrane which contains an anion exchanger and adjoins the cathode space, where the cathode makes contact with the first ion exchange membrane,
- an anode space comprising an anode,
- an extraction space which is disposed between the first ion exchange membrane and the anode space, wherein the extraction space comprises a porous, ion-conducting solid-state electrolyte that makes at least partial contact with the first ion exchange membrane and wherein an extraction medium has been incorporated in the extraction space, wherein the extraction medium comprises water in an amount of 0% to 50% by weight, preferably 0% to 30% by weight, further preferably 0% to 10% by weight, and at least one organic solvent, the method comprising:

- feeding the extraction medium through at least one first feed into the extraction space;
- introducing a first gas stream comprising $CO_2$ and/or CO, especially $CO_2$, into the cathode gas space in such a way that the $CO_2$ and/or CO, especially $CO_2$, comes into contact with the cathode;
- converting $CO_2$ and/or CO, especially $CO_2$, at the cathode to at least one first cathode product;
- admitting or transferring the at least one first cathode product to the extraction space;
- optionally converting the at least one first cathode product to at least one first product in the extraction space;
- at least partly extracting the at least one first cathode product and/or if appropriate the at least one first product into the extraction medium; and
- draining off the extraction medium comprising, at least to some degree, the at least one first cathode product and/or if appropriate the at least one first product from the extraction space via at least one first drain for the extraction medium.

The method of the invention may especially be conducted with an apparatus of the invention. Accordingly, specific embodiments of the apparatus of the invention are also applicable to the method of the invention, and vice versa.

Even though the different steps are defined in a particular sequence in the method of the invention, it is not ruled out that two or more or even all steps take place in parallel.

Configurations of the method that refer to an electrolysis apparatus relate here correspondingly to configurations in particular that have already been described above in association with the apparatus of the invention, and so reference is hereby also made to these. In particular, the anode space, the anode, the cathode space, the cathode gas space, the cathode, the extraction space and the solid-state electrolyte, the first ion exchange membrane, any separator present, the at least one first gas feed, the at least one first feed for the extraction medium, the at least one first drain for the extraction medium, the extraction medium itself and any further constituents of the apparatus in association with the method of the invention may correspond, separately or in any combination, to those of the apparatus of the invention.

In the method, the step of feeding the extraction medium via at least one first feed into the extraction space is not particularly restricted, and the extraction medium may, for example, be pumped in, or in particular embodiments also circulated, i.e. cycled.

It is also the case that the introducing of a first gas stream comprising $CO_2$ and/or CO into the cathode gas space in such a way that the $CO_2$ and/or CO comes into contact with the cathode is not particularly restricted, and can be effected, for example, by direct flow to the cathode and/or by flow past the cathode in the flow direction of the extraction medium in the extraction space or in countercurrent thereto. The first gas stream may, for example, be introduced appropriately, for example blown in.

The conversion of $CO_2$ and/or CO, especially of $CO_2$, at the cathode to at least one first cathode product is not particularly restricted, and the conversion may depend on the cathode construction and especially also on the catalyst of the cathode, as set out above or known.

It is also the case that the passage or transfer of the at least one first cathode product to the extraction space is not particularly restricted, as indicated above. While anions, for example, can be conveyed through the first ion exchange membrane as the product of the electrolysis, it is possible, for example, for neutral, especially liquid, products of the electrolysis also to be allowed to pass through the first ion exchange membrane.

In particular embodiments, at least portions of the at least one first cathode product, e.g. anions, in the extraction space can be converted to a first product, for example after reaction with protons, to give an uncharged product such as formic acid or acetic acid, although this need not necessarily be the case for all first cathode products, and the two operations (passage and conversion of cathode products) may also take place in parallel.

The at least one first cathode product, or else two or more of these, and/or optionally also the at least one first product, or else two or more of these, having been formed in this way, may then be extracted at least partly or even completely in the extraction medium, although this, as described above, may depend on the extraction medium.

The draining of the extraction medium comprising, at least to some degree, the at least one first cathode product and/or if appropriate the at least one first product from the extraction space via at least one first drain for the extraction medium is not particularly restricted.

FIGS. 4 and 5 show illustrative methods of the invention in schematic form.

In FIG. 4, after the extraction medium 11 (including in parallel) has been fed into the extraction space via at least one first feed, a first gas stream comprising $CO_2$ and/or CO is introduced into the cathode gas space 12 such that the $CO_2$ and/or CO comes into contact with the cathode. Thereafter, $CO_2$ and/or CO is converted at the cathode to at least one first cathode product 13, the at least one first cathode product is admitted or transferred to the extraction space 14, the at least one first cathode product is at least partly extracted into the extraction medium 15, and the extraction medium comprising, at least to some degree, the at least one first cathode product is drained off from the extraction space via at least one first drain for the extraction medium 16.

In FIG. 5, steps 11 to 14 correspond to those of FIG. 4. Thereafter, in the method according to FIG. 5, the at least one first cathode product is converted to at least one first product in the extraction space 17, the at least one first cathode product and the at least one first product are at least partly extracted into the extraction medium 15*a*, and the extraction medium comprising, at least to some degree, the at least one first cathode product and the at least one first product is drained off from the extraction space via at least one first drain for the extraction medium 16*a*. What is not shown, but is also possible, in addition, is that even solely the at least one first product is extracted and drained off, for example when all of the at least one first cathode product is being converted to at least one first product.

In particular embodiments, a first separator is disposed between the anode space and the extraction space, in which case the porous, ion-conducting solid-state electrolyte makes at least partial contact with the first separator. Accordingly, it is then possible here, for example, to conduct protons formed at the anode into the extraction space via the first separator, for example a CEM, but this is also possible without a separator, for example when the anode also assumes the separator function, in which case the solid-state electrolyte makes at least partial direct contact with the anode.

In particular embodiments, the first ion exchange membrane has a conductivity of 20 mS/cm or more, preferably 50 mS/cm or more, further preferably 100 mS/cm or more, and/or 300 mS/cm or less, preferably 200 mS/cm or less. In particular embodiments, the porous, ion-conducting solid-state electrolyte has a conductivity of 20 mS/cm or more, preferably 50 mS/cm or more, further preferably 100 mS/cm or more, and/or 300 mS/cm or less, preferably 200 mS/cm or less.

The at least one organic solvent is not particularly restricted. The at least one organic solvent may be matched here to a product to be extracted, and also take the form of a mixture of two or more organic solvents. For example, the organic solvent is selected from alcohols having 1 to 20 carbon atoms, esters, e.g. carboxylic esters, having 2 to 20 carbon atoms, ethers having 2 to 20 carbon atoms, polyethers having 3 to 20 carbon atoms, and/or aliphatic solvents having 5 to 20 carbon atoms, preferably from alcohols having 1 to 20 carbon atoms, esters, e.g. carboxylic esters, having 2 to 20 carbon atoms, ethers having 2 to 20 carbon atoms, and/or polyethers having 3 to 20 carbon atoms. In particular embodiments, the organic solvent is selected from alcohols having 1 to 15 carbon atoms, esters having 1 to 15 carbon atoms, and/or ethers and/or polyethers having 2 to 15 carbon atoms.

In particular embodiments, the porous, ion-conducting solid-state electrolyte is a cation exchange resin, an anion exchange resin, and/or a resin having cation-exchanging and anion-exchanging groups.

In particular embodiments, the at least one first feed for the extraction medium and the at least one first drain for the extraction medium are connected such that the extraction medium can be circulated, in which case the extraction medium is circulated within the method. In this way, it is possible to achieve enrichment of the at least one first cathode product and/or optionally the at least one first product in the extraction medium. In particular embodiments, the at least one first cathode product and/or optionally the at least one first product may be at least partly withdrawn via a withdrawal apparatus. The withdrawal is not particularly restricted here.

In particular embodiments, the at least one first cathode product and/or if appropriate the at least one first product is concentrated in the extraction medium. The concentration is not particularly restricted and may comprise, for example, repeated recycling of the extraction medium, but also introduction into apparatuses for concentration, for example by selective removal of extraction medium, in order to make the separation as efficient as possible. The degree of accumulation here is preferably between 0-100%, further preferably between 20-60%, but more preferably between 60-100%. By suitable choice of the extraction medium and of the degree of accumulation of the at least one first cathode product and/or if appropriate the at least one first product, it is possible to guarantee effective separation from the extraction medium without detriment to ionic conductivity.

The above embodiments, configurations and developments can, if viable, be combined with one another as desired. Further possible configurations, developments and implementations of the invention also include combinations, not explicitly specified, of features of the invention that have been described above or hereinafter with regard to the working examples. In particular, the person skilled in the art will also add on individual aspects as improvements or supplementations to the respective basic form of the present invention.

The invention is elucidated further in detail hereinafter with reference to various examples thereof. However, the invention is not limited to these examples.

EXAMPLES

An illustrative construction for $CO_2$ electrolysis in one example of the present invention is shown in FIG. 6, in which the advantageous combination of cathode, first ion exchange membrane and solid-state electrolyte can be used.

In the example, $CO_2$ is guided to the cathode gas space 1, and gaseous products G such as CO, $C_2H_4$, $CH_4$, etc. that are formed at the cathode K, here a Cu-containing GDE, are drained off from the cathode gas space 1. Liquid products from cathode reduction and/or anions are pumped through the AEM as the first ion exchange membrane into the extraction space 3, in which there is a porous solid-state electrolyte 6. The solid-state electrolyte 6 here is in contact with both the AEM and a cation exchange membrane CEM as separator on the anode side. The CEM adjoins the anode A, which is adjoined by an anode gas space 5, where water, for example, is oxidized here at the anode A. For this purpose, it is possible to feed in an anolyte An. The construction of the anode side is not restricted here. By way of example, a ½ membrane electrode assembly (MEA) is shown here. Also conceivable is a zero-gap construction, etc. The dotted line shows a possible route for the anolyte.

On the anode side, $H_2O$ which is required by way of example for the evolution of oxygen that takes place (OER, oxygen evolution reaction) may, however, be provided by various options: firstly, as shown in FIG. 6, the water may be added via the anode side. For this purpose, according to FIG. 6, a second electrolyte system may be provided (see dotted system in FIG. 6). The anolyte is not restricted here and may be any desired electrolyte solution. Particular preference, however, is given to pure water, or an acid, preferably up to a concentration of 1 mol/L.

Alternatively, the water can be added via the extraction space 3, in which case the water can then migrate through the CEM. As a result, no further electrolyte system is needed; the dotted system in FIG. 6 can be dispensed with.

In the example, the extraction medium is circulated or recycled, such that a mixture of extraction medium with products E' accumulates in the reservoir, where the products of the electrolysis can be concentrated on the cathode side, for example liquid products and/or dissolved products such as ethanol. Given a sufficiently high degree of accumulation, the product can then be separated off in a further step. Given sufficient concentration, a mixture M3 with extraction medium E comprising, at least to some degree, the at least one first cathode product and/or if appropriate the at least one first product can be branched off from the reservoir and guided to a withdrawal apparatus 7 in which the mixture M3 is separated into product P' and extraction medium E. The possibly diluted recovered extraction medium E is then returned to the reservoir and hence to the cell system again.

In principle, the illustrative construction shown is also suitable for the production of CO at the cathode. A formic acid formed at 1% by weight can then be separated effectively from the electrolyte circuit.

A point of particular significance for the construction is the use of a suitable porous solid-state electrolyte 6, which is advantageously not soluble here in the extraction medium E. Accordingly, the stability of various solid-state electrolytes 6 in the extraction medium E was examined in reference experiments as to the suitability of various ion exchangers as solid-state electrolyte.

For this purpose, first experiments were done with Amberlite® IRN150 and IR120H$^+$ in diethyl ether as extraction medium. For this purpose, 2.5 g of the respective ion-conductive exchange resin was mixed with 7.5 g of diethyl ether. After 150 h, both batches and a diethyl ether reference were analyzed by $^1$H NMR. If the exchange resins break down in diethyl ether and/or go into solution, this would become clearly visible in the corresponding spectra by comparison with the reference R.

The results are shown in FIGS. 7 and 8. The intensity I is normalized to the strongest diethyl ether peak (roughly at a chemical shift $\delta$=1 ppm). The peak at about 4.7 ppm can be assigned to $H_2O$, while the peak at about 6.5 ppm is assigned to the internal standard. All peaks below $\delta$=4 ppm can be assigned to diethyl ether. Otherwise, both in the overall spectrum in FIG. 7 and in the enlarged spectrum in FIG. 8 (×100 zoom in intensity), it is not possible to measure any other H-sensitive dissolved or decomposed H-sensitive molecules originating from the solid-state electrolyte. As a result of the stability of the porous ion-conducting solid-state electrolyte examined, the stability of the system can be assured.

The invention provides an apparatus and a method in which it is possible by the use of a solid-state electrolyte to separate ionic conductivity from an extraction medium, such that it is possible, for example, to concentrate liquid and/or dissolved products in the extraction medium and to use non-ion-conductive media wholly or partly, and, for example, to use water-miscible solvents, for example alcohols having different boiling points or water-immiscible solvents such as ethers, aliphatics or esters as extraction medium. In addition, it is possible via the use of an anion-conducting membrane or layer, especially one which is not soluble to extraction, directly adjoining the cathode, for example a GDE, to enable continuous electrolysis operation in the electrolysis of CO and/or $CO_2$, especially $CO_2$. The assurance of continuous operation of electrolysis, as enabled by the invention, is particularly advantageous.

In this way, it is possible to electrochemically reduce $CO_2$ continuously on an industrial scale in electrolyzers and hence to produce and provide materials of value in chemistry, and simultaneously to reduce the volume of existing $CO_2$.

The substantial or complete avoidance of water in the extraction medium, and use of organic solvents such as alcohols, esters and ethers, etc., allows effective extraction, accumulation and then also workup of main products (for example liquid products such as ethanol) from $CO_2$ electrolysis to hydrocarbons ($CO_2$-to-hydrocarbons).

The invention claimed is:

1. An apparatus for electrolysis of $CO_2$ and/or CO, comprising:

a cathode space comprising a cathode gas space and a cathode, wherein the cathode is designed to convert $CO_2$ and/or CO from the cathode gas space to at least one first cathode product, wherein the cathode preferably takes the form of a gas diffusion electrode;

at least one first gas feed which is connected to the cathode gas space and is designed to supply the cathode gas space with a first gas stream comprising $CO_2$ and/or CO;

a first ion exchange membrane which contains an anion exchanger and adjoins the cathode space, wherein the cathode makes contact with the first ion exchange membrane;

an anode space comprising an anode;

an extraction space which is disposed between the first ion exchange membrane and the anode space, wherein the extraction space comprises a porous, ion-conducting solid-state electrolyte that makes at least partial contact with the first ion exchange membrane, wherein the first ion exchange membrane is configured to admit the at least one first cathode product at least partly into an adjacent extraction space and/or to convey it into the extraction space;

wherein an extraction medium has been incorporated in the extraction space, wherein the extraction medium comprises water in an amount of 0% to 50% by weight and at least one organic solvent, wherein the extraction medium is designed to at least partly extract the at least one first cathode product and/or if appropriate at least one first product formed by reaction from the at least one first cathode product, and wherein the extraction medium is not an ion-conducting medium;

at least one first feed for the extraction medium, which is designed to supply the extraction space with the extraction medium; and at least one first drain for the extraction medium, which is designed to drain off the extraction medium comprising at least to some degree the at least one first cathode product and/or if appropriate the at least one first product.

2. The apparatus as claimed in claim 1, further comprising:

a first separator disposed between the anode space and the extraction space, wherein the porous, ion-conducting solid-state electrolyte makes at least partial contact with the first separator.

3. The apparatus as claimed in claim 1, wherein the first ion exchange membrane has a conductivity of 20 mS/cm or more.

4. The apparatus as claimed in claim 1, wherein the porous, ion-conducting solid-state electrolyte has a conductivity of 20 mS/cm or more.

5. The apparatus as claimed in claim 1, wherein the at least one organic solvent is selected from alcohols having 1 to 15 carbon atoms, esters having 2 to 15 carbon atoms, and/or ethers and/or polyethers having 2 to 15 carbon atoms.

6. The apparatus as claimed in claim 1, wherein the porous, ion-conducting solid-state electrolyte is a cation exchange resin, an anion exchange resin and/or a resin having cation-exchanging and anion-exchanging groups.

7. The apparatus as claimed in claim 1, wherein the at least one first feed for the extraction medium and the at least one first drain for the extraction medium are connected such that the extraction medium can be circulated, further optionally comprising a withdrawal apparatus for the at least one first cathode product and/or if appropriate the at least one first product.

8. A method of electrolysis of $CO_2$ and/or CO in an electrolysis cell comprising a cathode space comprising a cathode gas space and a cathode, wherein the cathode preferably takes the form of a gas diffusion electrode, a first ion exchange membrane which contains an anion exchanger and adjoins the cathode space, where the cathode makes contact with the first ion exchange membrane;

an anode space comprising an anode;

an extraction space which is disposed between the first ion exchange membrane and the anode space, wherein the extraction space comprises a porous, ion-conducting solid-state electrolyte that makes at least partial contact with the first ion exchange membrane and wherein an extraction medium has been incorporated in the extraction space, wherein the extraction medium comprises water in an amount of 0% to 50% by weight and at least one organic solvent, and wherein the extraction medium is not an ion-conducting medium, the method comprising:

feeding the extraction medium through at least one first feed for the extraction medium into the extraction space;

introducing a first gas stream comprising $CO_2$ and/or CO into the cathode gas space in such a way that the $CO_2$ and/or CO comes into contact with the cathode;

converting $CO_2$ and/or CO at the cathode to at least one first cathode product;

admitting or transferring the at least one first cathode product to the extraction space;

optionally converting the at least one first cathode product to at least one first product in the extraction space;

at least partly extracting the at least one first cathode product and/or if appropriate the at least one first product into the extraction medium; and draining off the extraction medium comprising, at least to some degree, the at least one first cathode product and/or if appropriate the first product from the extraction space via at least one first drain for the extraction medium.

9. The method as claimed in claim 8, wherein there is a first separator disposed between the anode space and the extraction space, wherein the porous, ion-conducting solid-state electrolyte makes at least partial contact with the first separator.

10. The method as claimed in claim 8, wherein the first ion exchange membrane has a conductivity of 20 mS/cm or more, preferably 50 mS/cm or more, further preferably 100 mS/cm or more, and/or 300 mS/cm or less, preferably 200 mS/cm or less.

11. The method as claimed in claim 8, wherein the porous, ion-conducting solid-state electrolyte has a conductivity of 20 mS/cm or more, preferably 50 mS/cm or more, further preferably 100 mS/cm or more, and/or 300 mS/cm or less, preferably 200 mS/cm or less.

12. The method as claimed in claim 8, wherein the at least one organic solvent is selected from alcohols having 1 to 15 carbon atoms, esters having 2 to 15 carbon atoms, and/or ethers and/or polyethers having 2 to 15 carbon atoms.

13. The method as claimed in claim 8, wherein the porous, ion-conducting solid-state electrolyte is a cation exchange resin, an anion exchange resin and/or a resin having cation-exchanging and anion-exchanging groups.

14. The method as claimed in claim 8, wherein the at least one first feed for the extraction medium and the at least one first drain for the extraction medium are connected such that the extraction medium can be circulated, wherein the extraction medium is circulated, optionally wherein the at least one first cathode product and/or if appropriate the at least one first product is at least partly withdrawn via a withdrawal apparatus.

15. The method as claimed in claim 8, wherein the at least one first cathode product and/or if appropriate the at least one first product is concentrated in the extraction medium.

16. The apparatus as claimed in claim 1, wherein the extraction medium comprises a conductivity of 50 mS/cm or less.

17. The apparatus as claimed in claim 1, wherein the porous, ion-conducting solid-state electrolyte comprises a polymer resin.

18. The apparatus as claimed in claim 1, wherein the extraction medium comprises water in an amount of 0% to 10% by weight.

19. The apparatus as claimed in claim 1, wherein the first ion exchange membrane has a conductivity of at least 100 mS/cm and at most 200 mS/cm.

20. The apparatus as claimed in claim 1, wherein the porous, ion-conducting solid-state electrolyte has a conductivity of at least 100 mS/cm and at most 200 mS/cm.

* * * * *